US008899081B2

(12) United States Patent
Pukari et al.

(10) Patent No.: US 8,899,081 B2
(45) **Date of Patent: *Dec. 2, 2014**

(54) ELECTROMECHANICAL LOCK

(75) Inventors: Mika Pukari, Oulu (FI); Toivo Pääkkönen, Nakertaja (FI); Petteri Karjalainen, Kajaani (FI); Jyrki Kananen, Kempele (FI); Mauri Arvola, Kempele (FI)

(73) Assignee: iLoq Oy, Oulu (FI)

( * ) Notice: Subject to any disclaimer, the term of this patent is extended or adjusted under 35 U.S.C. 154(b) by 584 days.

This patent is subject to a terminal disclaimer.

(21) Appl. No.: 12/669,207

(22) PCT Filed: Jul. 16, 2008

(86) PCT No.: PCT/FI2008/050432

§ 371 (c)(1),
(2), (4) Date: Jan. 15, 2010

(87) PCT Pub. No.: WO2009/010635

PCT Pub. Date: Jan. 22, 2009

(65) Prior Publication Data

US 2010/0185331 A1 Jul. 22, 2010

(30) Foreign Application Priority Data

Jul. 18, 2007 (EP) ..... 07112677

(51) Int. Cl.
*E05B 47/06* (2006.01)
*E05B 47/00* (2006.01)

(52) U.S. Cl.
CPC ..... *E05B 47/0012* (2013.01); *E05B 2047/002* (2013.01); *E05B 2047/0031* (2013.01); *E05B 2047/0062* (2013.01)
USPC ..... 70/277; 70/278.3; 70/278.7; 70/283.1

(58) Field of Classification Search
USPC ..... 70/222, 223, 277, 278.2, 278.3, 278.7, 70/279.1, 283.1; 340/5.65, 542
See application file for complete search history.

(56) References Cited

U.S. PATENT DOCUMENTS

| | | | | |
|---|---|---|---|---|
| 4,912,460 | A * | 3/1990 | Chu | 340/5.67 |
| 5,265,452 | A | 11/1993 | Dawson et al. | |
| 6,038,895 | A * | 3/2000 | Menke et al. | 70/278.1 |
| 6,331,812 | B1 * | 12/2001 | Dawalibi | 340/5.2 |
| 6,370,928 | B1 * | 4/2002 | Chies et al. | 70/278.3 |
| 6,389,856 | B1 * | 5/2002 | Watanuki et al. | 70/186 |
| 6,845,642 | B2 * | 1/2005 | Imedio Ocana | 70/277 |
| 7,140,214 | B2 * | 11/2006 | Lindstrom | 70/278.3 |

(Continued)

FOREIGN PATENT DOCUMENTS

| | | |
|---|---|---|
| DE | 9419736 U1 | 2/1995 |
| DE | 19519789 A1 | 12/2005 |
| EP | 1808816 A1 | 7/2007 |

(Continued)

*Primary Examiner* — Lloyd Gall
(74) *Attorney, Agent, or Firm* — Birch, Stewart, Kolasch & Birch, LLP

(57) ABSTRACT

An electromechanical lock, and its operation method are disclosed. The method includes: generating electric power from mechanical power by an electric generator; reading data from an external source with the electric power; matching the data against a predetermined criterion with the electric power; powering the electric generator by the electric power; and setting the lock mechanically from a locked state to a mechanically openable state by the electric generator, provided that the data matches the predetermined criterion.

20 Claims, 12 Drawing Sheets

(56) References Cited

U.S. PATENT DOCUMENTS

| | | | | |
|---|---|---|---|---|
| 7,168,276 | B2 * | 1/2007 | Errani et al. | 70/278.7 |
| 8,228,030 | B2 * | 7/2012 | Pukari et al. | 320/114 |
| 2005/0235714 | A1 * | 10/2005 | Lindstrom | 70/493 |
| 2006/0156771 | A1 * | 7/2006 | Hauri | 70/278.7 |
| 2009/0229326 | A1 * | 9/2009 | Pukari et al. | 70/263 |
| 2010/0188190 | A1 * | 7/2010 | Pukari et al. | 340/5.6 |
| 2011/0174029 | A1 * | 7/2011 | Lappalainen et al. | 70/279.1 |

FOREIGN PATENT DOCUMENTS

| | | | |
|---|---|---|---|
| EP | 2017413 | A1 | 1/2009 |
| EP | 2017795 | A1 | 1/2009 |
| WO | WO-99/18310 | A1 | 4/1999 |
| WO | WO-2007/068794 | A1 | 6/2007 |

* cited by examiner

ELECTROMECHANICAL LOCK

FIELD

The invention relates to an electromechanical lock, and its operation method.

BACKGROUND

Various types of electromechanical locks are replacing the traditional mechanical locks. Electromechanical locks require an external supply of electric power, a battery inside the lock, a battery inside the key, or means for generating electric power within the lock making the lock user-powered. Further refinement is needed for making the electromechanical locks to fit into a small space and to be reliable.

BRIEF DESCRIPTION

The invention is defined in the independent claims.

LIST OF DRAWINGS

Embodiments of the present invention are described below, by way of example only, with reference to the accompanying drawings, in which FIG. 1A illustrates an embodiment of a key;

DESCRIPTION OF EMBODIMENTS

The following embodiments are exemplary. Although the specification may refer to "an", "one", or "some" embodiment(s) in several places, this does not necessarily mean that each such reference is made to the same embodiment(s), or that the feature only applies to a single embodiment. Single features of different embodiments may also be combined to provide other embodiments.

Figure 3A:
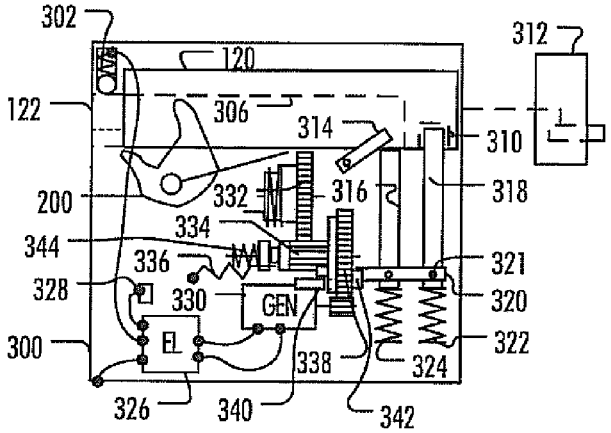
FIG. 3A illustrates an embodiment of a user-powered electromechanical lock.

With reference to FIG. 3A, the structure of an electromechanical lock 300 is explained. The lock 300 comprises an electronic circuit 326 configured to read data from an external source, and match the data against a predetermined criterion. The electronic circuit 326 may be implemented as one or more integrated circuits, such as application-specific integrated circuits ASIC. Other embodiments are also feasible, such as a circuit built of separate logic components, or a processor with its software. A hybrid of these different embodiments is also feasible. When selecting the method of implementation, a person skilled in the art will consider the requirements set for the power consumption of the device, production costs, and production volumes, for example.

The external source may be an electronic circuit configured to store the data. The electronic circuit may be an iButton® (www.ibutton.com) of Maxim Integrated Products, for example; such an electronic circuit may be read with 1-Wire® protocol. The electronic circuit may be placed in a key, for example, but it may be positioned also in another suitable device or object. The only requirement is that the electronic circuit 326 of the lock 300 may read the data from the external electronic circuit. The data transfer from the external electronic circuit to the electronic circuit 326 of the lock 300 may be performed with any suitable wired or wireless communication technique. In user-powered locks, produced energy amount may limit the techniques used. Magnetic stripe technology or smart card technology may also be used as the external source. Wireless technologies may include RFID technology, or mobile phone technology, for example. The external source may be a transponder, an RF tag, or any other suitable electronic circuit type capable of storing the data.

The data read from the external source is used for authentication by matching the data against the predetermined criterion. The authentication may be performed with SHA-1 (Secure Hash Algorithm) function, designed by the National Security Agency (NSA). In SHA-1, a condensed digital representation (known as a message digest) is computed from a given input data sequence (known as the message). The message digest is to a high degree of probability unique for the message. SHA-1 is called "secure" because, for a given algorithm, it is computationally infeasible to find a message that corresponds to a given message digest, or to find two different messages that produce the same message digest. Any change to a message will, with a very high probability, result in a different message digest. If security needs to be increased, other hash functions (SHA-224, SHA-256, SHA-384 and SHA-512) in the SHA family, each with longer digests, collectively known as SHA-2 may be used. Naturally, any suitable authentication technique may be used to authenticate the data read from the external source. The selection of the authentication technique depends on the desired security level of the lock 300 and possibly also on the permitted consumption of electricity for the authentication (especially in user-powered electromechanical locks).

The lock 300 also comprises an electric generator 330 configured to generate the electric power from mechanical power. The lock 300 is user-powered, i.e. the user generates all the mechanical and electrical power needed for operating the lock 300. The electric generator 330 may be a permanent magnet generator, for example. The output power of the electric generator 330 may depend on rotating speed, terminal resistance and terminal voltage of the electronic and the constants of the electric generator 330. The generator constants are set when the electric generator 330 is selected. The electric generator 330 may be implemented by a Faulhaber motor 0816N008S, which is used as a generator, for example. The term electric generator refers to any generator/motor capable of generating electric power from mechanical power.

The lock 300 also comprises a power transmission mechanism configured to convey the mechanical power to the electric generator 330, and to disengage from the electric generator 330 with the mechanical power after generating the electric power. The power transmission mechanism may be any mechanism capable of receiving mechanical power from a user and conveying the mechanical power to the electric generator 330. Figures of this application will illustrate such a power transmission mechanism that is capable of receiving the mechanical power from a key insertion. Nevertheless, the power transmission mechanism may be configured to receive the mechanical power from turning of a handle or a knob, from insertion of a key-like moving object, or from moving any other mechanical system.

The power transmission mechanism may be, during locking of the lock, configured to return to a starting position, to reset mechanically the electric generator 330 to the locked state, and to re-engage with the electric generator 330.

The electric generator 330 is further configured, after the power transmission mechanism has been disengaged, to be powered by the electric power. The electric generator 330 is also configured to receive electronic control from the electronic circuit 326 provided that the data matches the predetermined criterion, and to set the lock mechanically from a locked state to a mechanically openable state. The electric generator 330 may also be configured to receive other electronic control from the electronic circuit 326 provided that the data does not match the predetermined criterion, and to set the lock 300 mechanically to the locked state. The latter may be implemented so that the generated electric power is used to "drive" the electric generator 330 as the actuator towards the closed position so as to render it more difficult to tamper with the lock 300.

In effect, the electric generator 330 is used both to generate the electric power needed to operate the lock 300 and to operate as an actuator of the lock 300 with the generated electric power. The "actuator" refers to a device that is capable of setting the lock mechanically from a locked state to a mechanically openable state. The actuator is described in greater detail in another simultaneously filed application: EP 07112673.4. Such a solution enables the lock 300 to be fitted into a smallest possible space, because instead of two devices (electric generator and actuator) only one device (combined electric generator and actuator) is needed. Furthermore, as the same device is used for the electric generation and the actuation, a possibly stuck device is warmed up and released during the electric generation. If needed, the electric generation cycle may be repeated as many times as necessary to release the stuck surfaces of the electric generation/actuation device. If the devices are separate, it is difficult to release the stuck surfaces of the actuator. With the integrated solution, reliability of operation is increased if the lock 300 is seldom used or it is located in cold or moist environment.

The lock 300 may further comprise a clutch 334 configured to engage the power transmission mechanism with the electric generator 330 in order to convey the mechanical power to the electric generator 330, and to disengage the power transmission mechanism from the electric generator 330 with the mechanical power after generating the electric power. The clutch refers to a mechanism for transmitting rotation, which can be engaged and disengaged. Clutches are useful in devices that have two rotating shafts. In the present case, one shaft belongs to the power transmission mechanism and the other shaft belongs to the electric generator 330. The clutch 334 may be a dry clutch, i.e. it is not bathed in fluid.

The clutch 334 may comprise a main wheel 338 configured to move by the electric generator 330 after the clutch 334 is disengaged in order to set the lock to the mechanically openable state.

The clutch 334 may also comprise a spring 344 configured to tense while the clutch 334 is disengaged, and to supply the mechanical power for the clutch 334 to reset the main wheel 338 while the clutch 334 is re-engaged.

The clutch 334 may be configured, when disengaged, to let the electric generator 330 to move the main wheel 338 only a limited, predetermined distance.

The main wheel 338 may comprise an aperture and the clutch 334 may further comprise a pin configured to move within the aperture while engaging and disengaging the clutch 334. The pin and the aperture may be so configured that the position of the pin within the aperture determines a limited predetermined distance the electric generator 330 is allowed to move the main wheel 338. These will be explained in greater detail in connection with FIGS. 5A to 5F and 6A to 6I. The clutch 334, when disengaged, may then provide only a limited movement possibility to the main wheel 338. Using that kind of clutch 334, makes it possible to keep the main wheel 338 in the same position after opening and closing cycle. Later, in FIGS. 5A to 5F, the clutch 334 is configured with a movement axial to a shaft of the generator 330: 1) to enable free rotation of the main wheel 338 to open position when the clutch 334 is disengaged, and 2) to return the main wheel 338 to the closed position when the clutch 334 is re-engaged, and, in FIGS. 6A to 6H, the clutch 334 is configured with a movement perpendicular to the shaft of the generator 330: 1) to enable free rotation of the main wheel 338 to open position when the clutch is disengaged, and 2) to return the main wheel 338 to closed position when the clutch is re-engaged.

The power transmission mechanism may comprise a key follower 200 configured to couple with a key inserted in the lock 300. The key follower 200 may comprise a swing lever 206 configured to supply the mechanical power for enabling the actuator operations (disengaging the power transmission mechanism). The key follower 200 is described in greater detail in another simultaneously filed application: EP 07112676.7.

The key follower 200 may be configured to organize timing of the lock 300 in relation to an insertion of a key as follows:

during a first insertion phase, convey the mechanical power to the electric generator 330;

during a second insertion phase, mechanically enable operation of the actuator 330; and during a third insertion phase, make the electronic circuit 326 electronically control the actuator 330 so as to set the lock 300 to the mechanically openable state provided that the data matches the predetermined criterion.

With this kind of timing, as many as possible of the lock 300 operations are performed with the mechanical power, and only when absolutely necessary, (user-generated) electric power is consumed for the operations.

Figure 1A:
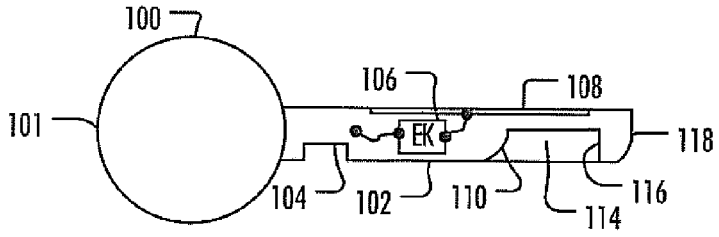
FIGS. 1B and 1C illustrate various positions of the key.
Figure 1B:
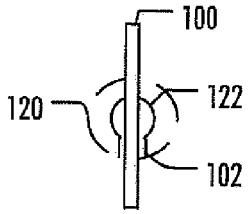
Figure 1C:
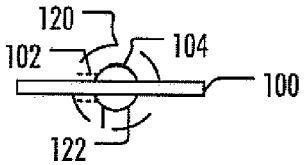

With reference to FIG. 1A, the structure of a key 100 is explained. Furthermore, FIGS. 1B and 1C illustrate positions of the key 100 in the lock 300.

The key 100 for an electromechanical lock 300 comprises a first 118 shape configured to engage, during the insertion of the key 100, with the key follower 200 of the lock 300 to mechanically transmit mechanical power produced by a user of the lock 300 to the electric generator 330 of the lock 300.

The key 100 also comprises a gap 114, positioned between the first shape 118 and a second shape 110, configured to provide, during the insertion of the key 100, a delay for generating electric power, and for an electronic circuit 326 of the lock 300 to read data from a source external to the lock 300, and match the data against a predetermined criterion.

The key 100 also comprises a second shape 110 configured to engage, during the insertion of the key 100, with the key follower 200 to mechanically enable operation of an actuator 330 of the lock 300, and make the electronic circuit 326 electronically control the actuator 330 to set the lock 300 to the mechanically openable state provided that the data matches the predetermined criterion.

The key 100 may also comprise a third shape 116 configured to engage, during a removal phase of the key 100 by the user, with the key follower 200 to return the key follower 200 to a starting position and mechanically reset the actuator 330 to the locked state.

The key 100 may also comprise an electronic circuit 106 configured to store the data. As was explained earlier, the electronic circuit 106 may be an iButton®, for example.

The key 100 may be configured to engage with a lock cylinder 120 of the lock and together with the lock cylinder 120 be rotatable from a key 100 insertion position to a lock open position. The key 100 may also comprise a fourth shape 104, such as a rotating position shape, configured to engage with the lock 300 so that the key 100 is removable from the lock 300 only in the key insertion position. Correspondingly the lock 300 comprises the lock cylinder 120 configured to be rotatable from a key 100 insertion position to a lock 300 open position, and the lock 300 may be configured so that the key 100 is only removable in the key 100 insertion position.

The key 100 may also comprise various other parts. As illustrated in FIG. 1A, the key 100 may also comprise a key grip 101 and a key body 102 (in the form of a bar, for example). The key 100 may also comprise key electronics 106 connected to a sliding contact 108 and the key body 102. The key electronics 106 may comprise, as mentioned earlier, the electronic circuit for storing the data (read by the electronic circuit 326 of the lock 300). The key body 102 may also have axial guides for better positioning control.

In FIG. 1B, the key 100 is shown in a zero position. In the zero position the key 100 may be inserted in or withdrawn from the lock 300 through the keyway shape 122.

In FIG. 1C, the key 100 is rotated off the zero position. While in the off-zero position, the key body 102 and the keyway shape 122 of the lock prevent removal of the key 100.

Figure 2A:
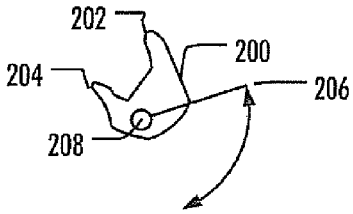
FIGS. 2A, 2B and 2C illustrate an embodiment of a key follower and its positions.
Figure 2B:
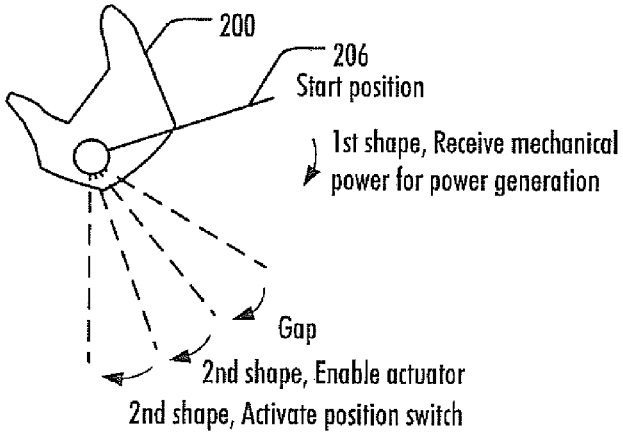
Figure 2C:
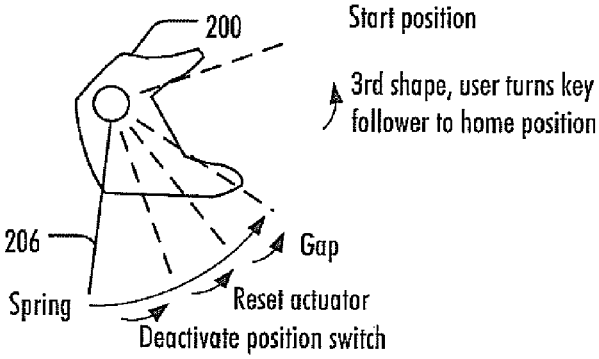

Next, with reference to FIGS. 2A, 2B and 2C the key follower 200 and its positions within the electromechanical lock are explained.

The key follower 200 may be a rotating key follower described in FIG. 2A, but also other forms may be suited for the implementation. The rotating key follower 200 may rotate around a shaft 208. As the key follower 200 of FIG. 2A is in a sense a gearwheel with two cogs, and the key 100 has the matching "cogs", this principle may be applied by the skilled person for the implementation of the key 100 and its follower 200.

The key follower 200 may comprise a first claw 202 configured to engage with the key 100 during the first insertion phase.

The key follower 200 may also comprise a second claw 204 configured to engage with the key 100 during the second insertion phase and the third insertion phase.

The key follower 200 may also comprise a swing lever 206.

Figure 3B:
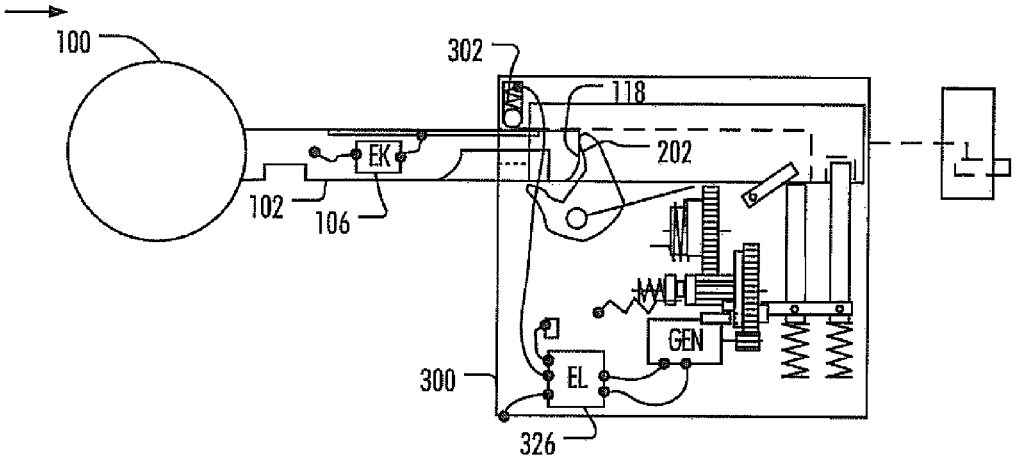
FIGS. 3B, 3C, 3D, 3E, 3F, 3G, 3H, 3I and 3J illustrate its operations.
Figure 3C:
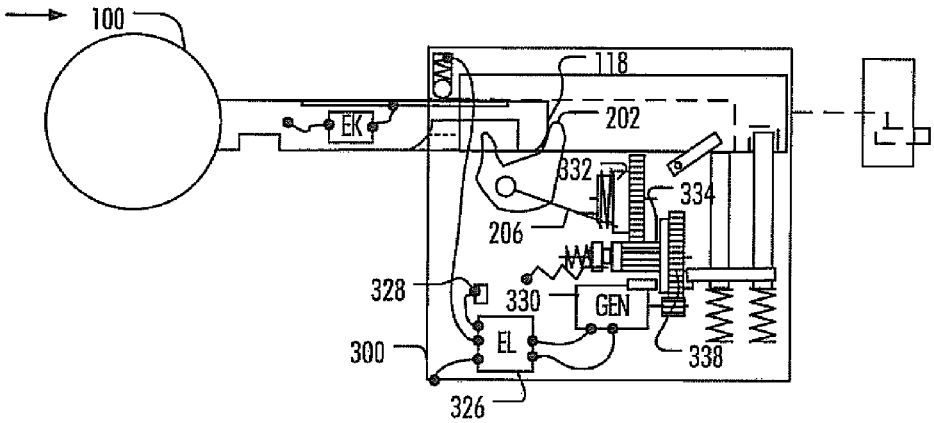
Figure 3D:
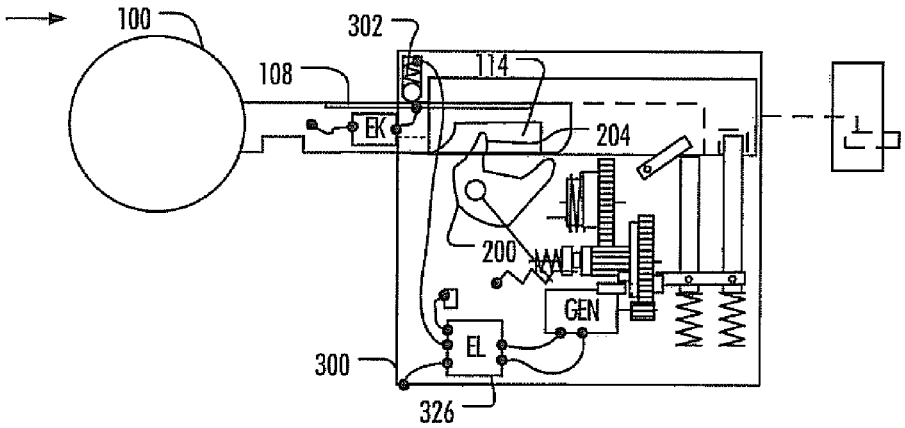
Figure 3E:
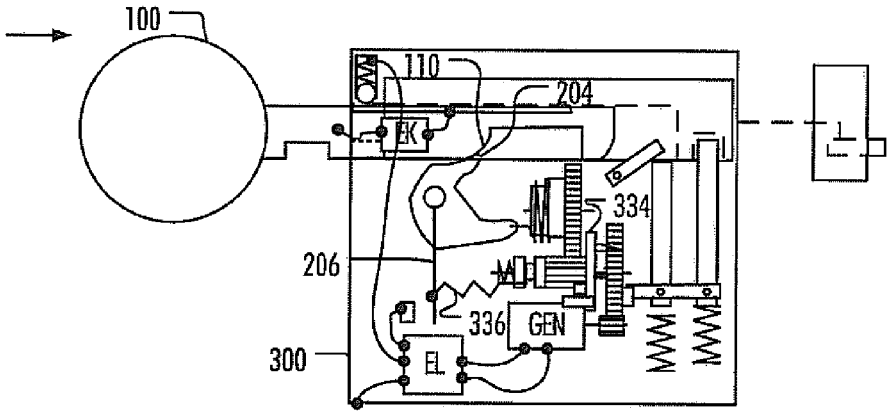
Figure 3F:
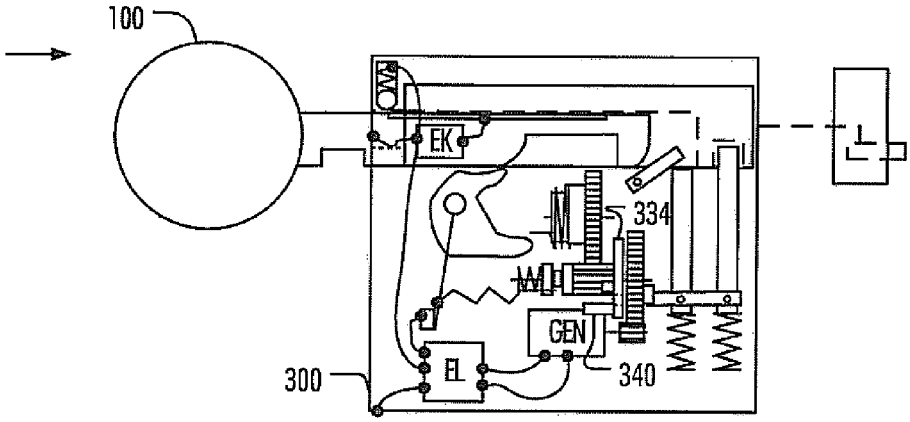
Figure 3G:
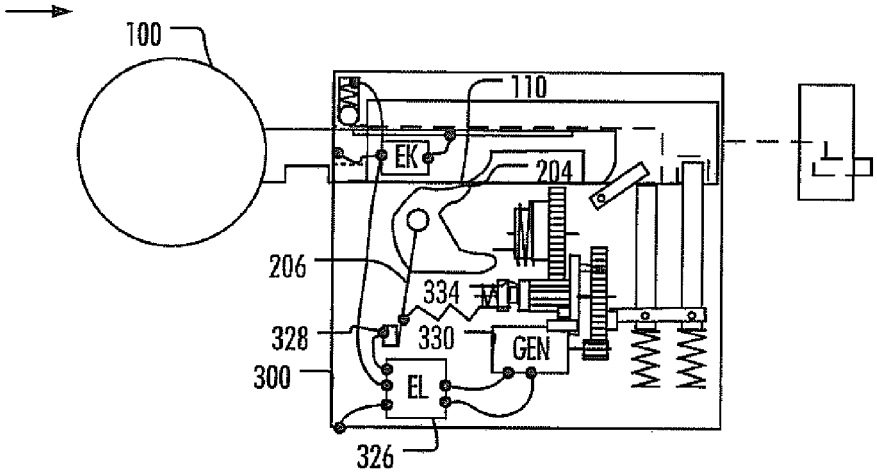
Figure 3H:
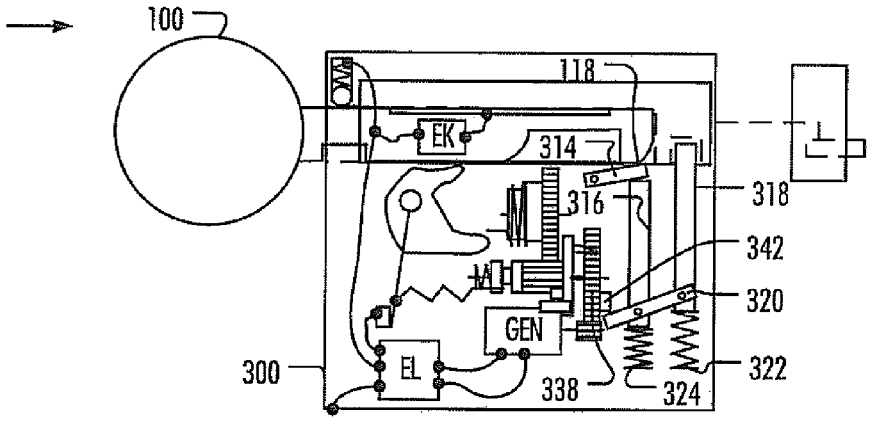

FIG. 2B illustrates the positions and functions of the key follower 200 when the key 100 is inserted into the lock 300:

FIGS. 3B and 3C will further illustrate reception of mechanical power with the first shape 118 of the key 100;

FIG. 3D will further illustrate the operation allowed by the gap 114 of the key;

FIGS. 3E and 3F will further illustrate the operation of the actuator with the second shape 110 of the key 100; and FIGS. 3G, 3H and 31 will further illustrate the operation after the position switch 328 is activated by the second shape 110 of the key.

FIG. 2C illustrates the positions and functions of the key follower 200 when the key 100 is withdrawn from the lock 300: the key follower 200 may be returned to the gap 114 position by a spring, whereby the position switch 328 is deactivated and the actuator 330 is reset, and after that the third shape 116 of the key 100 may return the key follower 200 to its home position. FIG. 3J will further illustrate these operations. The key follower 200 may be configured to return, during a removal phase of the key 100, to a starting position and mechanically reset the actuator 330 to the locked state.

FIG. 3A illustrates many other possible components of the lock 300. The lock 300 may further comprise keyways 122, 306, an electric contact 302, a support 342, a driving pin 316, a locking pin 318, a lever 320, an arm 314, springs 322, 324, 344, a threshold device 332, a main wheel 338, a stopper 340, a position switch 328, a lock cylinder 120, and a clutch opener 336. Furthermore, the lock may be coupled to bolt mechanism 312. The electric generator 330 may rotate through the main wheel 338 when the threshold device 332 is moving, provided that the clutch 334 is closed.

The support 342 may be configured to move by electric power to a fulcrum position provided that the data matches the predetermined criterion, i.e. provided that the data is authenticated. The support 342 may be configured to be reset from the fulcrum position with mechanical power when the key is removed from the lock 300. The mechanical power may be provided by the spring 344, for example.

The locking pin 318 may be configured to hold the lock 300, when engaged, in a locked state, and, when disengaged, in a mechanically openable state. The locking pin 318 may be configured to engage with mechanical power when the key is removed from the lock. The mechanical power may be provided by the spring 322, for example. This is explained below in connection with FIG. 3J. The locking pin 318 may be configured to implement the locked state so that, when engaged, the locking pin 318 holds the lock cylinder 120 stationary, and to implement the mechanically openable state so that, when disengaged, the locking pin 318 releases the lock cylinder 120 rotatable by mechanical power. In the third-class lever the input effort is higher than the output load, but the input effort moves through a shorter distance than the load, i.e. with such lever 320 the locking pin 318 may securely hold the lock cylinder 120 in place in the locked state as the locking pin 318 penetrates deep enough into the wall of the lock cylinder 120. A cavity 310 may be formed in the lock cylinder 120 for the locking pin 318.

The lever 320 may be configured to receive mechanical power, and to output the mechanical power to mechanically disengage the locking pin 318 provided that the support 342 is in the fulcrum position.

The driving pin 316 may be configured to input the mechanical power to the lever 320. The lever 320 may be configured to receive the mechanical power from an insertion of a key. As illustrated in FIG. 3A, the lever 320 may be a third-class lever: the fulcrum is at the left-hand end of the lever 320, the mechanical power is inputted into the middle of the lever 320, and the mechanical power is outputted from the right-hand end of the lever 320.

A coupling 321 between the lever 320 and the locking pin 318 may act as another fulcrum, and the locking pin 318 remains stationary in a locked position provided that the data does not match the predetermined criterion, i.e. provided that the support 342 is not moved to the fulcrum position.

FIG. 3B illustrates the lock status when the first shape 118 of the key 100 is inserted against the first claw 202 in the lock 300. The key electronics 106 may be connected to the electronic circuit 326 so that one electrical connection is made between the electric contact 302 and the slide contact 108, and the other electrical connection between the key body 102 and the lock frame 300.

In FIG. 3C, the key 100 is inserted to a threshold position in the lock 300: the first shape 118 of the key 100 is still in contact with the first claw 202. The threshold device 332 is armed by the swing lever 206. When the key 100 is inserted deeper into the lock, the threshold device 332 is launched and it returns to the home position by a spring. Electric power is produced by the electric generator 330 to the electronic circuit 326 when the threshold device 332 is moving. The threshold device 332 is illustrated in more detail in other applications by the applicant: EP 05 112 272.9 and PCT/FI2006/050543.

In FIG. 3D, the key 100 continues to move into the lock 300. The key follower 200 is not moving because the second claw 204 is in the gap 114 of the key 100: delay is made for the electric power generation and the communication. After a sufficient voltage level is reached, the electronic circuit 326 starts, communicates with the key electronics 106 through the electric contacts 302, 108, and authenticates the key 100.

In FIG. 3E, the second claw 204 is pushed forward by the second shape 110 of the key. The actuator operation is enabled by opening the clutch 334 with the swing lever 206 and the clutch opener 336.

In FIG. 3F, the actuator enabling operation is started before the power generation phase is ended, i.e. the key 100 may be inserted too fast into the lock 300. In such a case, the actuator operation is disabled, because the clutch 334 may only be opened when it is returned to the home position against to the stopper 340. The lock 300 cannot be opened.

Figure 5A:
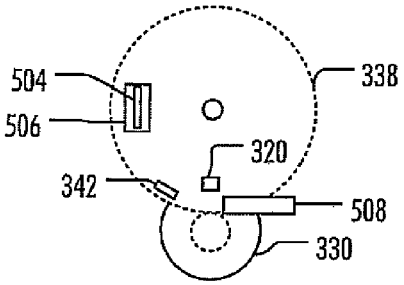
FIGS. 5A, 5B, 5C, 5D, 5E and 5F illustrate an embodiment of an electronic control and mechanical reset of the locking mechanism.
Figure 5B:
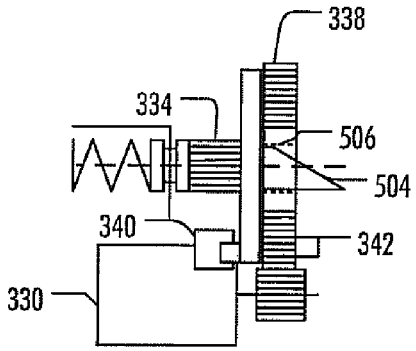

In FIGS. 5A and 5B, the clutch 334 is closed and rotation of the main wheel 338 is blocked by the shapes 504, 506. The main wheel 338 is not rotatable by the electric generator 330, and the support 342 is not set under the lever 320. The locking pin 318 is kept in closed position, even though the driving pin 316 is pushed down by the user of the key 100.

In FIG. 3G, the clutch 334 is opened and the position switch 328 is activated by the second claw 204 and the end of the second shape 110 of the key. The electronic circuit 326 controls the generator 330 as an electric motor when the position switch 328 is activated as follows: the generator 330 is driven in the open direction as illustrated in FIGS. 5E and 5F, if the key 100 is authenticated, and kept in the closed position as illustrated in FIGS. 5C and 5D, if the key 100 is not authenticated.

In FIG. 3H, the main wheel 338 is kept in the closed position. The support 342 is not under the lever 320. The arm 314, the driving pin 316 and the lever 320 are pushed down by the first shape 118 of the key, but the locking pin 318 is kept in the closed position by the spring 322 and the lock 300 cannot be opened. As shown, the lever 320 misses the support 342 (and hence the fulcrum), if the key 100 is not authenticated. The mechanics of the lock 300 remain secure against malicious manipulation.

Figure 3I:
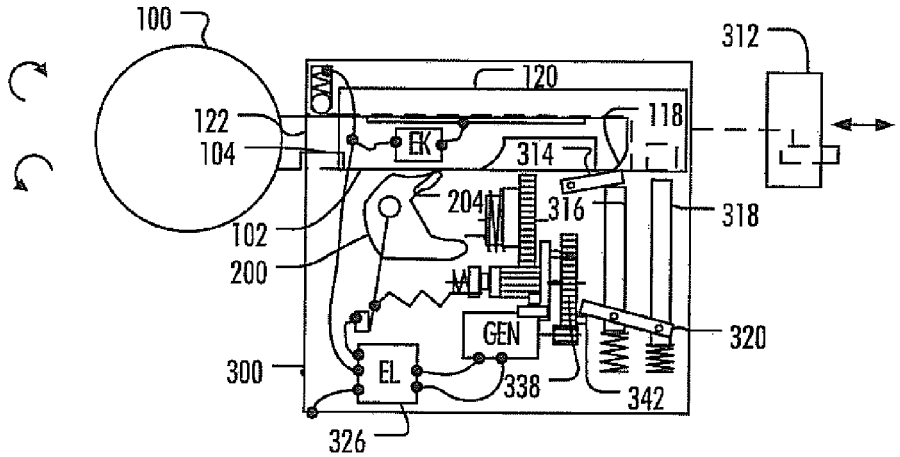
Figure 3J:
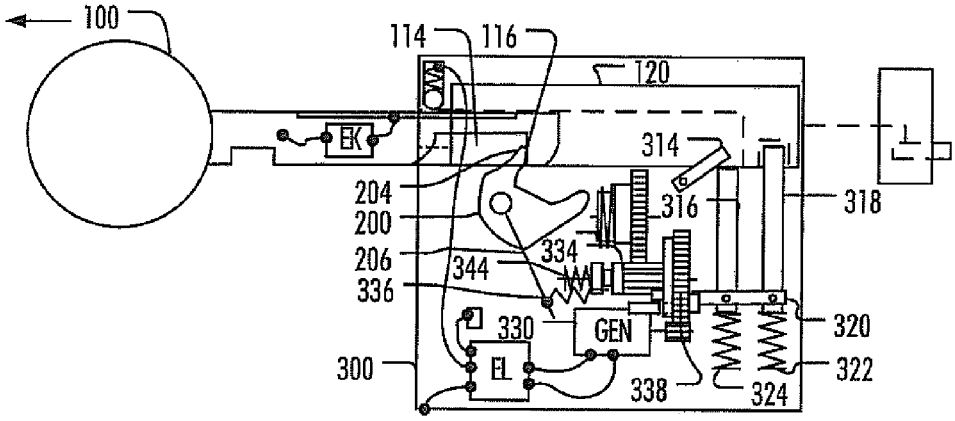

In FIG. 3I, the main wheel 338 is driven to the open position by the electronic circuit 326. The support 342 is set under the lever 320. The arm 314 and the driving pin 316 are pushed down by the first shape 118 of the key 100, and the locking pin 318 is pushed down through the lever 320 by the driving pin 316. As a result, the lock 300 is in the mechanically openable state, and the bolt mechanism 312 may be moved by rotating the key 100. When the key 100 is rotated, the lock cylinder 120 provides support for the second claw 204 of the key follower 200 so that it keeps its position during rotation. The key 100 has to be returned to the zero position, as illustrated in FIG. 1B, before it may be withdrawn from the lock 300.

Figure 5C:
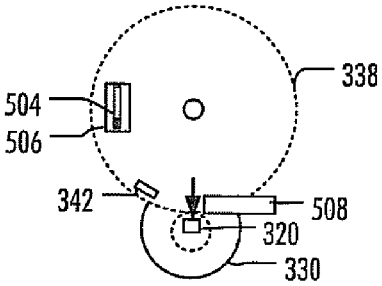
Figure 5D:
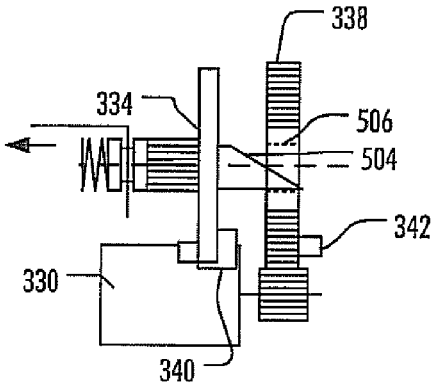
Figure 5E:
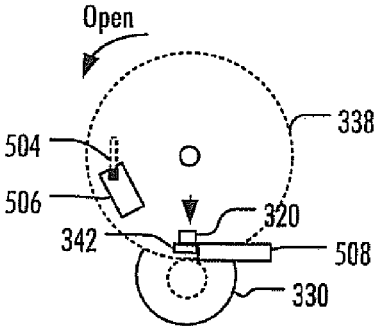
Figure 5F:
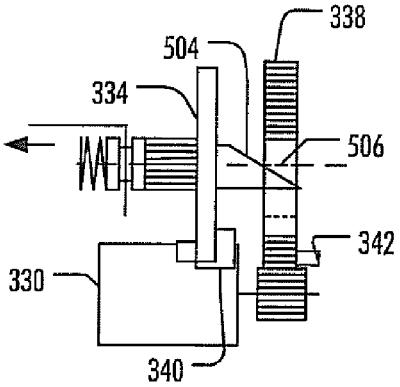

The opening is also illustrated in FIGS. 5C and 5D. The clutch 334 is opened and rotation of the main wheel 338 is enabled by the shapes 504, 506. As further illustrated in FIGS. 5E and 5F, the main wheel 338 is rotated by the electric generator 330 to the stopper 508, the support 342 is set under the lever 320, and the locking pin 318 may be opened by the user of the key 100 through the arm 314, the driving pin 316 and the lever 320.

In FIG. 3J, withdrawal of the key 100 is in progress. The locking pin 318 is returned to the closed position by the spring 322. The driving pin 316 and the arm 314 are returned to their initial positions by the spring 324. The lever 320 is returned to initial position together with the driving pin 316 and the locking pin 318. The clutch 334 is closed by the spring 344 and the main wheel 338 is reset. The second claw 204 is returned into the gap 114 by the clutch opener 336. The third shape 116 of the key 100 and the second claw 204 return the key follower 200 to the starting position as illustrated in FIGS. 3B and 2C, when the key 100 is withdrawn from the lock 300.

Figure 4A:
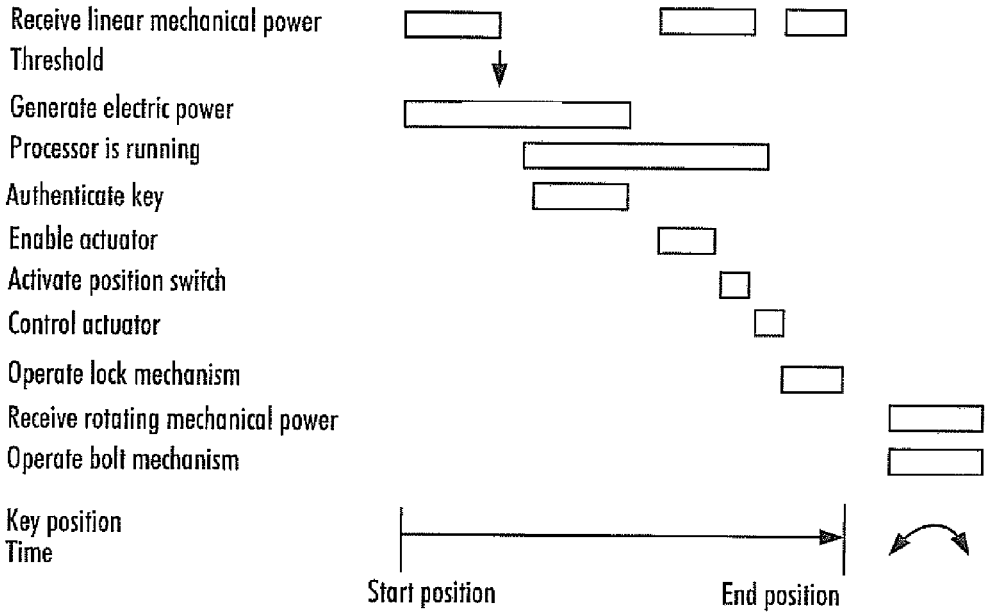
FIGS. 4A and 4B illustrate timing and order of the operations in the electromechanical lock.

FIG. 4A illustrates the order of the lock functions when the key 100 is inserted into the lock 300 in a specified speed. From the key 100 insertion, linear mechanical power is received. Electric power is generated with a part of the received linear mechanical power. A processor of the lock electronics 326 starts when sufficient voltage is generated and it stops when voltage drops below a sufficient level. The key 100 is authenticated with the generated electric power. The actuator is enabled with the mechanical power. The position switch 328 is activated after the key 100 has been inserted in a required depth. Thereupon, the actuator is controlled with the generated electric power, and the lock mechanism is further operated with the mechanical power. If the insertion speed of the key 100 is so slow that the voltage drops below the sufficient level before the position switch 328 is activated, the actuator 330 is not driven, and the lock 300 remains in the locked state. If the key 100 is inserted too fast, the position switch 328 is activated before the key authentication process is ready, and the lock 300 is kept in the closed state. Finally, rotating mechanical power is received and used to operate the bolt mechanism 312.

Figure 4B:
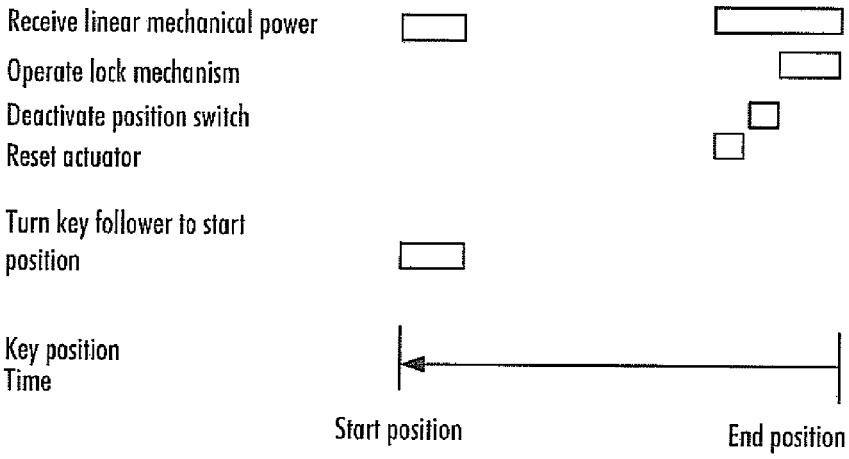

FIG. 4B illustrates the lock functions when the key 100 is withdrawn from the lock 300. Linear mechanical power is received from the key 100 removal. With the received mechanical power, the lock mechanism is operated, and, after the position switch 328 is deactivated, the actuator is reset. Thereupon, the key follower 200 is turned to the start position with the mechanical power.

Next, with reference to FIGS. 6A, 6B, 6C, 6D, 6E, 6F, 6G and 6H there is illustrated a clutch configured to engage and disengage with a movement perpendicular to a shaft of the electric generator 330, as opposed to the clutch of FIGS. 5A to 5F configured to engage and disengage with a movement axial to a shaft of the electric generator 330.

Figure 6A:
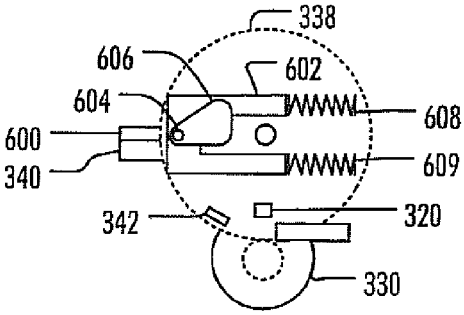
FIGS. 6A, 6B, 6C, 6D, 6E, 6F, 6G, 6H and 6I illustrate another embodiment of an electronic control and mechanical reset of the locking mechanism.
Figure 6B:
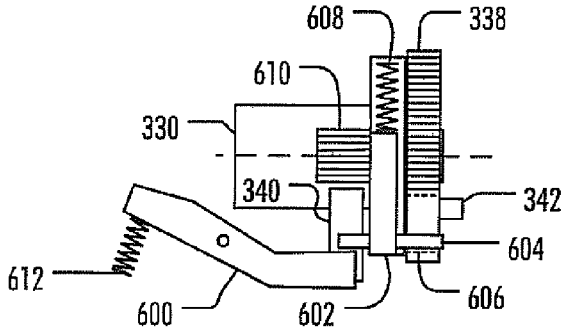

The clutch of FIG. 6A comprises an arm 600, a slide 602, a pin 604, an aperture 606, springs 608, 609, 612, and a gear body 610, and it may be implemented to the power transmission mechanism illustrated in FIGS. 3A to 3J. The slide 602 is coupled to the gear body 610 and they are rotated by the threshold device 332. The pin 604 is against the stopper 340, while the threshold device 332 is in the home position. The pin 604 of the slide 602 is pushed outwards by the spring 608, when the clutch is engaged. The pin 604 and the aperture 606 of the main wheel 338 constitute an engagement/disengagement mechanism as illustrated in FIGS. 6A to 6D. In FIGS. 6A and 6B, the main wheel 338 is not rotatable to open position by the electric generator 330, and the support 342 is not set under the lever 320. The locking pin 318 is kept in the closed position, even though the driving pin 316 is pushed down by the user of the key 100.

Figure 6C:
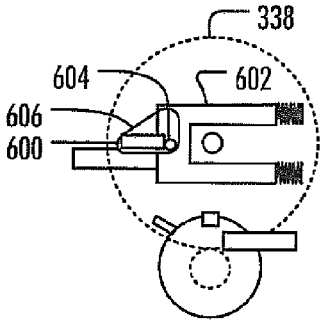
Figure 6D:
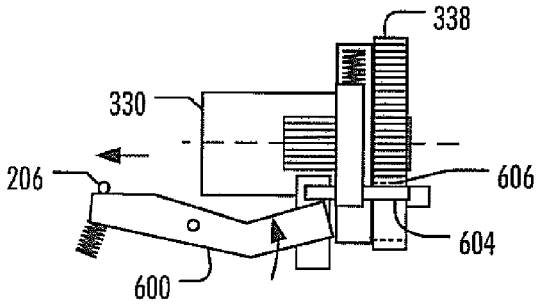

In FIGS. 6C and 6D, the slide 602 is pushed inwards by pushing the pin 604 with an arm 600, which is turned by the swing lever 206, and rotation of the main wheel 338 is enabled by the pin 604 and the aperture 606.

Figure 6E:
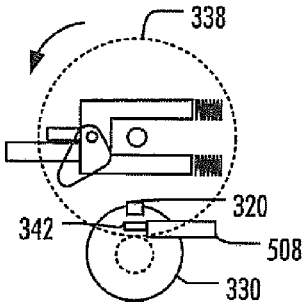
Figure 6F:
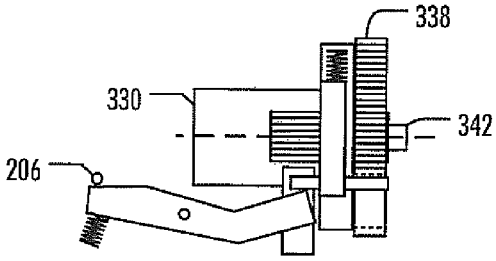

As further illustrated in FIGS. 6E and 6F, the main wheel 338 is rotated by the electric generator 330 to the stopper 508, the support 342 is set under the lever 320, and the locking pin 318 may be opened by the user of the key 100 through the arm 314, the driving pin 316 and the lever 320. After that, the opening state is reset when the key 100 is withdrawn and the swing lever 206 is returned. The arm 600 is returned by a spring 612, and the slide 602 is closed, pushed outwards by the springs 608, 609 and the main wheel 338 is reset by the aperture 606 and the pin 604. Engaged clutch position is illustrated in FIGS. 6A and 6B.

Figure 6G:
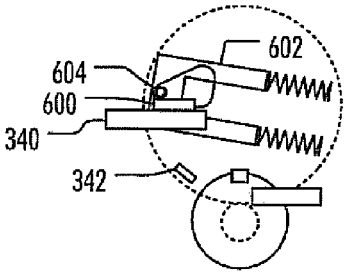
Figure 6H:
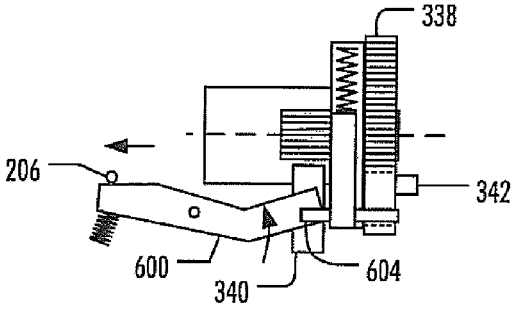

In FIGS. 6G and 6H, disengagement of the clutch is tried before the pin 604 is returned against the stopper 340 (by the threshold device). The arm 600 is moved between the stopper 340 and the pin 604. The slide 602 is not moved, and the support 342 is not allowed to rotate under the lever 320.

Figure 6I:
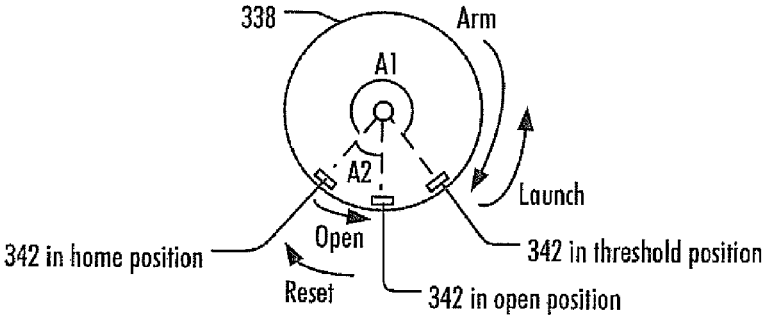

FIG. 6I illustrates operations of the lock 300 and positions of the support 342 in the main wheel 338 when the clutches 5A to 5F and 6A to 6H are used. When armed, the support 342 is turned clockwise to the threshold position by using mechanical power. An arming angle A1 may be 90 to 330 degrees, for example, in this case it is 280 degrees. After the threshold position is passed, the support 342 is turned anti-clockwise by the threshold device 332, electric power is produced and it is returned to the home position. If the clutch is opened as illustrated in FIGS. 5C, 5D 6C, and 6D, the support 342 is enabled to turn freely from the home position to an open position by the electric generator 330. The driving angle A2 may be 90 to 15 degrees, for example, in this case it is 40 degrees. The arming angle A1 and the driving angle A2 may be defined so that enough electric power is produced for electronics and for driving the driving angle A2. Security of the lock against tampering may also be considered when the minimum driving angle is defined. Angles A1 and A2 may also be defined so that the support 342 goes to the open position only driven by the electric generator 330.

Figure 7:
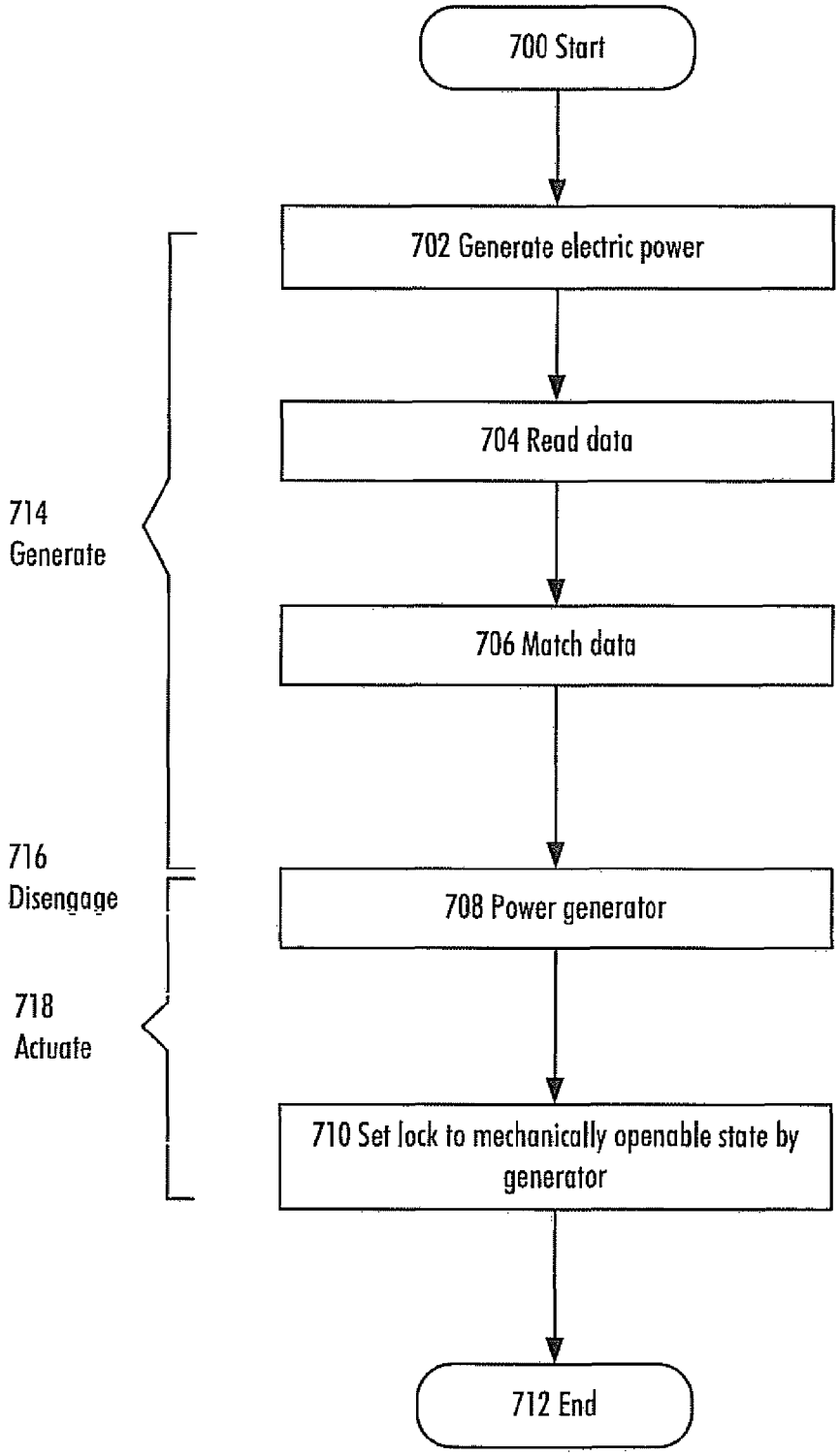
FIG. 7 illustrates a method for operating an electromechanical lock.

Next, a method for operating an electromechanical lock will be described with reference to FIG. 7. Other functions, not described in this application, may also be executed between the operations or within the operations. The method starts in 700.

In 702, electric power is generated from mechanical power by an electric generator. In 704, data is read from an external source with the electric power. In 706, the data is matched against a predetermined criterion with the electric power. As illustrated with 714, the electric power generation in 702 may continue at least partly in parallel with 704 and possibly also with 706.

In 708, the electric generator is powered by the electric power.

In 710, the lock is mechanically set from a locked state to a mechanically openable state by the electric generator provided that the data matches the predetermined criterion.

The method is divided, in a way, into two phases: a generation phase 714 with the electric generator, and an actuation phase 718 with the electric generator. Between these two phases 714 and 718, a disengagement point may exist; the power transmission mechanism may be disengaged from the electric generator so that the electric generator may operate as the actuator.

The method ends in 712.

The method may be enhanced with the embodiments of the electromechanical lock described earlier.

It will be obvious to a person skilled in the art that, as technology advances, the inventive concept can be implemented in various ways. The invention and its embodiments are not limited to the examples described above but may vary within the scope of the claims.

The invention claimed is:

1. An electromechanical lock, comprising:

a cylinder having a keyway;

an electric generator configured to generate electric power from mechanical power;

an electronic circuit, powered by the electric power, configured to read data from an external source, and match the data against a predetermined criterion;

a power transmission mechanism configured to convey the mechanical power to the electric generator;

a locking pin engaging the cylinder to prevent rotation of the cylinder;

a clutch having a closed position to supply power from the power transmission mechanism to the electric generator and an open position to disengage the power transmission mechanism from the electric generator; and the electric generator is further configured, when the clutch is in the open position, to be powered by the electric power, to receive electronic control from the electronic circuit provided that the data matches the predetermined criterion, and to set the lock mechanically from a locked state wherein the cylinder is prevented from rotation to a mechanically openable state wherein the cylinder can rotate.

2. The lock of claim 1, wherein the clutch is further configured to engage and disengage with a movement axial to a shaft of the electric generator.

3. The lock of claim 1, wherein the clutch is further configured to engage and disengage with a movement perpendicular to a shaft of the electric generator.

4. The lock of claim 1, wherein the clutch comprises a main wheel configured to move by the electric generator after the clutch is disengaged in order to set the lock to the mechanically openable state.

5. The lock of claim 4, wherein the clutch comprises a spring configured to tense while the clutch is disengaged, and to supply the mechanical power for the clutch to reset the main wheel while the clutch is re-engaged.

6. The lock of claim 4, wherein the clutch is configured, when disengaged, to let the electric generator to move the main wheel only a limited, predetermined distance.

7. The lock of claim 4, wherein the main wheel comprises an aperture and the clutch further comprises a pin configured to move within the aperture while engaging and disengaging the clutch.

8. The lock of claim 7, wherein the pin and aperture are so configured that the position of the pin within the aperture determines a limited, predetermined distance the electric generator is allowed to move the main wheel.

9. The lock of claim 1, wherein the electric generator is further configured to receive other electronic control from the electronic circuit provided that the data does not match the predetermined criterion, and to set the lock mechanically to the locked state.

10. The lock of claim 1, wherein the power transmission mechanism is, during locking of the lock, further configured to return to a starting position, to mechanically set the electric generator to correspond to the locked state of the lock, and to engage with the electric generator.

11. The lock of claim 1, wherein the power transmission mechanism comprises a key follower configured to couple with a key inserted in the lock.

12. The lock of claim 11, wherein the key follower comprises a swing lever configured to supply the mechanical power for moving the clutch to the open position.

13. The lock of claim 2, wherein the electric generator is further configured to receive other electronic control from the electronic circuit provided that the data does not match the predetermined criterion, and to set the lock mechanically to the locked state.

14. The lock of claim 3, wherein the electric generator is further configured to receive other electronic control from the electronic circuit provided that the data does not match the predetermined criterion, and to set the lock mechanically to the locked state.

15. The lock of claim 4, wherein the electric generator is further configured to receive other electronic control from the electronic circuit provided that the data does not match the predetermined criterion, and to set the lock mechanically to the locked state.

16. The lock of claim 5, wherein the electric generator is further configured to receive other electronic control from the electronic circuit provided that the data does not match the predetermined criterion, and to set the lock mechanically to the locked state.

17. The lock of claim 1, further comprising:

a lever attached to the locking pin;

a driving pin connected to the lever and positioned adjacent the keyway; and a main wheel having a support extending from the main wheel;

wherein the main wheel moves the support to a position under an end of the lever, and wherein the lever pivots about a fulcrum to move the locking pin radially when the driving pin is moved by insertion of a key into the keyway.

18. An electromechanical lock, comprising:

a cylinder having a keyway;

generating means for generating electric power from mechanical power;

conveying means for conveying the mechanical power to the generating means;

means for reading data from an external source;

matching means for matching the data against a predetermined criterion;

means for disengaging the conveying means from the generating means after generating the electric power;

means for preventing rotation of the cylinder; and means for disengaging the means for preventing rotation by moving the means for preventing rotation along a radial direction of the cylinder, wherein the generating means are powered by the electric power after the means for disengaging have disengaged the conveying means from the generating means, and the generating means receive electronic control from the matching means, provided that the data matches the predetermined criterion.

19. An electromechanical lock, comprising:

a cylinder having a keyway, the cylinder rotatable between a locked state and an unlocked state;

a driving pin, the driving pin moved downwardly by insertion of a key into the key bore keyway;

a lever attached to the driving pin, the lever having a first end and a second end;

a driven pin attached to the lever, the driven pin engaging the cylinder to prevent rotation of the cylinder; and an actuator, the actuator moving a support between a first position remote from the lever and a second position under the first end of the lever, wherein the support prevents downward movement of the second end of the lever when in the second position, and the lever retracts the driven pin from the cylinder to allow the cylinder to rotate in a mechanically openable state.

20. The lock of claim 10, wherein the support is a projection on a wheel, the wheel rotated by the actuator.

* * * * *